US008668216B2

(12) United States Patent
Ellement

(10) Patent No.: US 8,668,216 B2
(45) Date of Patent: Mar. 11, 2014

(54) ACCESS SYSTEM AND DEVICE FOR VEHICLES, AND MODES OF EMPLOYMENT THEREOF

(75) Inventor: Nathan John Ellement, Oakford (AU)

(73) Assignee: Barjoh Pty, Ltd, Oakford (AU)

( * ) Notice: Subject to any disclaimer, the term of this patent is extended or adjusted under 35 U.S.C. 154(b) by 194 days.

(21) Appl. No.: 12/922,990

(22) PCT Filed: Mar. 13, 2009

(86) PCT No.: PCT/AU2009/000296
§ 371 (c)(1),
(2), (4) Date: Nov. 30, 2010

(87) PCT Pub. No.: WO2009/114897
PCT Pub. Date: Sep. 24, 2009

(65) Prior Publication Data

US 2011/0140389 A1 Jun. 16, 2011

(30) Foreign Application Priority Data

Mar. 17, 2008 (AU) ..... 2008901284

(51) Int. Cl.
*E06C 5/04* (2006.01)
*E06C 5/16* (2006.01)

(52) U.S. Cl.
USPC ..... 280/166; 280/163; 182/127

(58) Field of Classification Search
USPC ..... 280/163, 166, 165, 169; 182/2.7, 41, 182/49, 62.5
See application file for complete search history.

(56) References Cited

U.S. PATENT DOCUMENTS

| | | | | | |
|---|---|---|---|---|---|
| 2,575,615 | A | | 11/1951 | Crump | |
| 2,933,149 | A | * | 4/1960 | Lee | 182/78 |
| 3,232,376 | A | * | 2/1966 | Lucas et al. | 182/97 |
| 3,656,578 | A | * | 4/1972 | Hemken | 182/20 |
| 3,695,389 | A | * | 10/1972 | Forestal et al. | 182/22 |
| 3,869,022 | A | * | 3/1975 | Wallk | 182/96 |
| 3,946,834 | A | * | 3/1976 | Shafer et al. | 182/164 |
| 3,997,183 | A | * | 12/1976 | Russey | 280/166 |
| 4,068,770 | A | * | 1/1978 | Boehringer | 414/537 |
| 4,131,293 | A | * | 12/1978 | Kindle | 280/166 |
| 4,243,120 | A | * | 1/1981 | Pratt et al. | 182/98 |
| 4,245,716 | A | * | 1/1981 | Rayfield | 182/86 |
| 4,971,168 | A | * | 11/1990 | Stanescu | 182/1 |
| 5,005,850 | A | * | 4/1991 | Baughman | 280/166 |
| 5,143,324 | A | * | 9/1992 | Cornelius et al. | 244/129.6 |
| 5,813,494 | A | * | 9/1998 | Ulschmid et al. | 182/97 |
| 5,988,316 | A | * | 11/1999 | Hedley | 182/127 |
| 5,996,737 | A | * | 12/1999 | Hedley et al. | 182/127 |

(Continued)

*Primary Examiner* — Jeffrey J Restifo
*Assistant Examiner* — Travis Coolman
(74) *Attorney, Agent, or Firm* — Cascio & Zervas

(57) ABSTRACT

A retractable access device (10) for a vehicle (30) having a longitudinal extent when deployed. The access device (steps, ladder, stairs) can have a multiplicity of treads (eg 10*a*, 10*b*, 10*c*.) interconnected in series by connectors (eg 12*a*, 13*a*, 14*a* . . . ) pivotably mounted with respect to the treads, the connectors permitting the access device to contract and extend longitudinally and the treads to be closed together on retraction. The treads may nest together when retracted (3*a*-3*d*) and treads can be formed or fabricated in pairs, such that when retracted, a tread of one pair nests between the treads of another pair, and this can be effected for multiple tread pairs. The access device is particularly suited to grader vehicles with limited and awkward cab access and space for access system deployment, not least due to the grader blade arrangement.

26 Claims, 6 Drawing Sheets

(56) References Cited

U.S. PATENT DOCUMENTS

| | | | | |
|---|---|---|---|---|
| 6,029,775 | A * | 2/2000 | Hedley et al. | 182/127 |
| 6,068,277 | A | 5/2000 | Magnussen | |
| 6,209,682 | B1 * | 4/2001 | Duffy et al. | 182/127 |
| 6,264,227 | B1 * | 7/2001 | Johnson et al. | 280/400 |
| 6,986,402 | B2 * | 1/2006 | Hedley et al. | 182/95 |
| 8,316,595 | B2 * | 11/2012 | Burford et al. | 52/183 |
| 2006/0070804 | A1 * | 4/2006 | Lapke et al. | 182/127 |
| 2007/0199258 | A1 * | 8/2007 | Reeves | 52/183 |
| 2009/0188444 | A1 * | 7/2009 | Whalen | 119/849 |
| 2010/0258379 | A1 * | 10/2010 | Mickens | 182/111 |

* cited by examiner

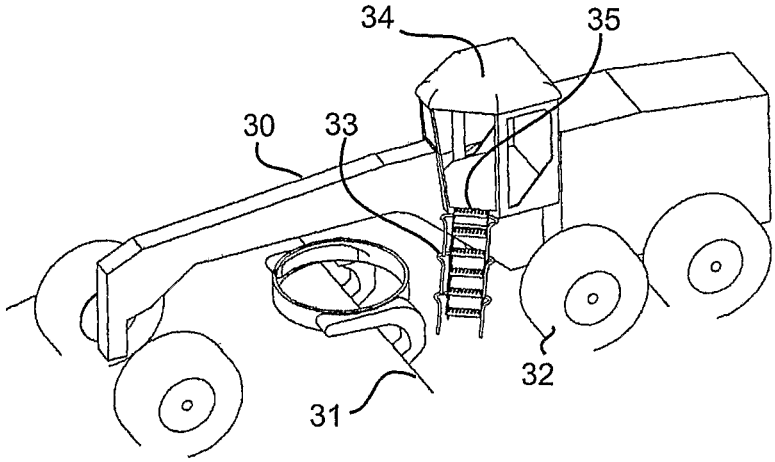
Fig 7a
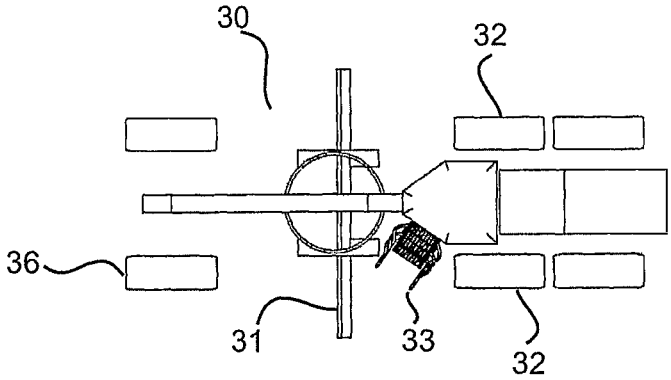
Fig 7b
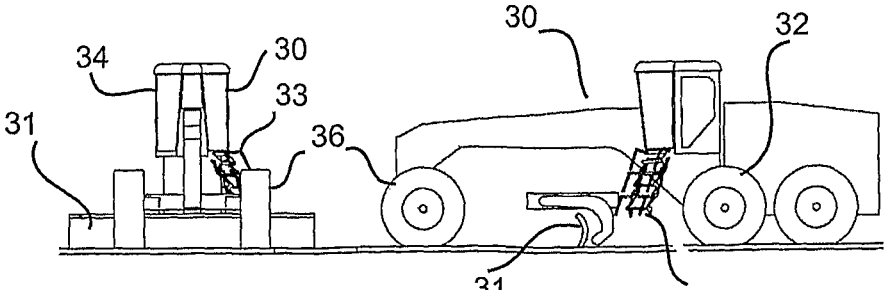
Fig 7c
Fig 7d

ACCESS SYSTEM AND DEVICE FOR VEHICLES, AND MODES OF EMPLOYMENT THEREOF

FIELD OF THE INVENTION

The present invention relates to access devices for vehicles, such as deployable/retractable access devices for earth moving equipment.

BACKGROUND OF THE INVENTION

Earth moving equipment, such as bulldozers generally includes a chassis, a working tool (bucket, blade, grab, drill etc), a protective driver cabin with access door, and some form of access or access system, such as fixed or moveable ladder or stair. The chassis includes all the mechanical parts that form the structural frame of the earth moving equipment. The driver operates the earth moving equipment from the protective driver cabin. A hatch is located behind the driver cabin and typically houses many of the important control units of the earth moving equipment vehicle such as hydraulic controls, hydraulic pump, fuse box, electrical circuit breakers etc. The access device provides access between the ground level and the cabin. Typically, though not always present, walkways are provided around the cabin area for an operator to access the hatch located behind the driver cabin of the earth moving equipment vehicle. The access device is usually attached to the walkway, chassis or cabin structure near the entry door to the cabin.

Retractable access systems of different configurations are presently known and have two final positions, namely the deployed position and the retracted position. The major types of access devices are the vertical variable height access system and the swing access system.

The vertical variable height access system would generally be used for large excavators and earth moving equipment. In the vertical variable height access system, the ladder or stairs would be operated vertically and would remain vertical both in the deployed position and retracted position. Essentially, the length of the ladder or stairs does not vary, rather, the ladder or stairs is simply lifted vertically upwards or lowered downwards.

In the swing type access system, the ladder or stairs when operated will swing (rotate) up or down to reach either the retracted position or deployed position respectively.

The basic constituents of any access system include a ladder or stairs and a mechanism to actuate the ladder or stairs. The ladder or stairs are generally made of metal such as steel or aluminium. The movement of the ladder or stairs in any access system is controlled by an actuator mechanism. The actuator mechanism moves the ladder or stairs between the deployed and the retracted position. This actuator is usually operated either mechanically, electrically or hydraulically. A combination of these means is also in practice.

Problems exist with certain types of earth moving equipment. For example, graders have at least one large blade used for levelling earth, soil, sand etc. The blade can be lifted/lowered, rotated and tilted, to allow for an initial level of the surface to be graded and/or to impart a required level to the surface. Basically the blade is set at a required angle, and the vehicle advanced over the surface such that the blade forms a particular slope or level to the surface. This is particularly prevalent when forming a level or particular sloping surface for the sides of new access roads where banks are required in virgin soil that is initially uneven. Graders are also used to re-level loose surface roads that incur holes, washout due to flooding or other disturbances that degrade the surface. These vehicles have a cabin for the operator immediately behind the blade. This position allows the operator to oversee the blade position and grading as the vehicle advances. However, because the cabin is above and between the blade to the front and the rear wheel behind, any access means has to extend downwards between the blade and rear wheel to permit access/egress. The blade of a grader is sufficiently maneuverable that the access means can be damaged or removed by impact from the blade swinging against the access means. In addition, for rotational retracting access means, because of limited space adjacent the side of the cabin, the operator's cabin door must be latched fully open or closed to avoid the access means damaging or removing a partially open door as it rotates to deploy/retract. Either instance can result in injury to the operator or other person, downtime of the vehicle and increased cost to the operator.

With the aforementioned in mind, it would be desirable to provide a retractable access device for earth moving equipment that is space saving in a retracted position, and preferably less prone to being damaged during operation.

A preferred object of the present invention would be to provide a retractable access device that does not affect the opening or closing of the cabin door of earth moving equipment.

SUMMARY OF THE INVENTION

With the aforementioned in view, one form of the present invention provides an access system for a vehicle, said system having an access device for mounting to the vehicle, and a mechanism for extending and retracting said access device, the access device being extendible from a contracted configuration for deployment to permit access to the equipment and retractable to a contracted configuration for normal operation of the equipment, the access device including a multiplicity of treads to support a user thereof during use, the treads being connected such that the access device retracts by contracting longitudinally with the treads closing together.

Beneficially, the access device contracting longitudinally permits the treads to close closer together, for example, in a concertina type arrangement, to a relatively compact form such that the access device is clear of the ground and does not require rotation to longitudinally position laying next to the cabin or up in the air. Such compact contraction saves space, and can permit the cabin door to open and close whilst the access device is retracting or deploying. This is especially useful where the access device is employed on a grader by helping to avoid potential damage from the blade and/or damaging the cabin door during retraction/deployment.

Deployment is preferably a reverse of the retraction arrangement.

In a preferred form, the access means may contract or extend in a concertina or scissor arrangement.

The treads may retract to a nested configuration with one tread overlaying the next, such as for improved compact storage.

Two or more of the treads may be interconnected by pivot linkages. The pivot linkages may include at least one link member pivotably connected at each end thereof to a respective tread.

Preferably a pair of link members may be pivotably mounted at each end of each member to each side of a respective tread to form a four bar linkage for each side between two consecutive treads.

The access system may include at least one handrail mounted to the access device. For example, at least one, preferably multiple, handrails may be mounted to the access device, and preferably each handrail may nest with an adjacent handrail when the access device is retracted. A handrail may be provided on one or more sections of a sectional access device, where each section has at least one tread unit including one or more treads.

Another form of the present invention provides an access system for a vehicle, including a sectional access device, each section including at least one tread unit having at least one tread for supporting a user and each section articulatory connected to at least one other said section by articulation connections such that the tread units close together during upward longitudinal retraction of the access device from a downwardly extended deployed orientation.

The sections may close together to form retracted access device with the tread units nested together.

Another form of the present invention provides a method of retracting a deployed access device for earth moving equipment, the access device including a multiplicity of treads for supporting a user, the method including bringing the treads closer together during a longitudinal contraction of the deployed access device.

Contraction of the access device may nest the treads adjacent one another in a retracted configuration.

The treads may be successively connected by respective linking means such that apply a force to retract the access device acts through the linking means to retractably bring the treads together.

The linking means may be linking members forming four bar linkages at either side of the treads, and retracting one tread causes a retraction force to be applied through the linkages to retract the connected tread or treads in a longitudinal direction of the access device.

Another form of the present invention provides a retractable access device for a vehicle, the access device having a longitudinal extent when deployed, and including a multiplicity of treads interconnected in series by connectors pivotably mounted with respect to the treads, the connectors permitting the access device to contract longitudinally.

Four bar type linkages may be used to connect the treads together. These may be provided either side of the treads. Consequently, a force applied to retract the access device, applied to or adjacent one tread, may be transferred through the connectors to the other treads, thereby bringing the treads closer together to a retracted configuration.

An access device according to one or more forms or embodiments of the present invention has treads that are connected such that they close together along an access device retraction axis, preferably whilst remaining in parallel.

The earth moving equipment is preferably a grader, which has particular issues and difficulties for access systems. The blade of a grader has an extensive range of movement, such that an extended/deployed access device (such as a set of steps or ladder) can be damaged or knocked off of the grader by the blade, even when retracted. Consequently an access system or device, such as an extending ladder or steps, needs to be compact when retracted to avoid the blade being moved to a position which would damage the ladder or steps. It is possible to punch the cabin windows out of the vehicle cabin with the blade and/or damage the door and/or steps if not operated correctly, as does happen. Also, it is desirable that the access device is sufficiently compact when retracted so as not to impede movement of the cabin door, such as for emergency egress of the operator or ventilation/protection when necessary.

It is also preferred that the access device have minimal effect on the visibility out of the machine when retracted

BRIEF DESCRIPTION OF THE DRAWINGS

FIG. 7*a* shows an access device according to an embodiment of the present invention in deployed mode on a grader.

FIGS. 7*b* to 7*d* show an access device according to an embodiment of the present invention in partially retracted mode on a grader.

Particular embodiments of the present invention will hereinafter be described, including with reference to accompanying figures. It will be appreciated that the embodiments described do not limit the generality of the present invention.

DESCRIPTION OF PREFERRED EMBODIMENTS

FIGS. 1*a* to 1*d* show various views of a section of an access device according to an embodiment of the present invention in extended/deployed configuration. It will be appreciated that the section of the access device, in this instance a set of steps or stair for a grader vehicle, can be extended in length by adding additional repeatable portions. The steps 10 include individual treads 10*a*-10*f*. These are pivotably linked by connectors 12*a* . . . 16*b*, which can be extended by addition of further connectors if a longer set of steps is required for a particular application. The connectors can act as four bar linkages to allow the steps to concertina closed, as shown through stages FIGS. 2 (partially closed) and 3 (fully closed).

Figure 1A:
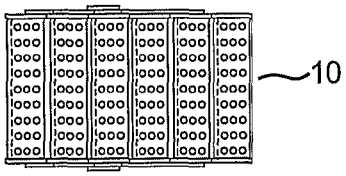
FIGS. 1*a* to 1*d* show various views of a section of an access device according to an embodiment of the present invention in extended/deployed configuration.
Figure 1B:
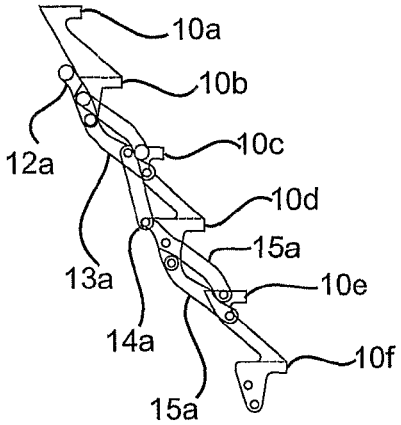
Figure 1C:
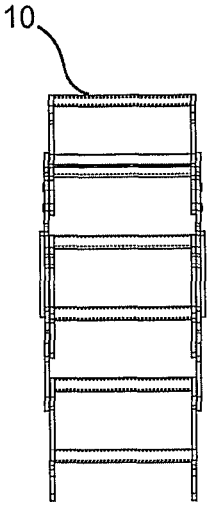
Figure 1D:
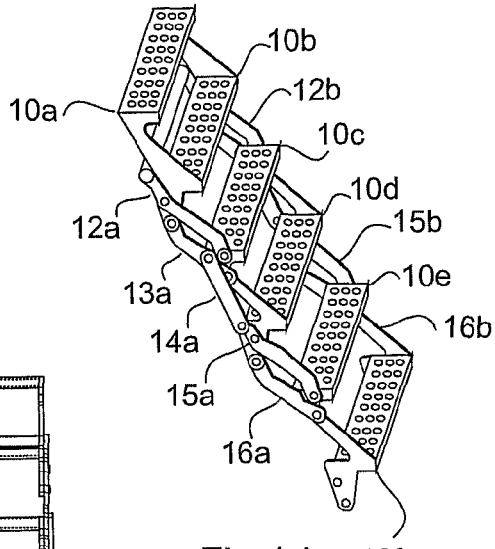
Figure 2A:
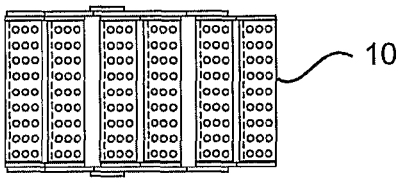
FIGS. 2*a* to 2*d* show various views of a section of an access device according to an embodiment of the present invention in partial extended/deployed configuration.
Figure 2D:
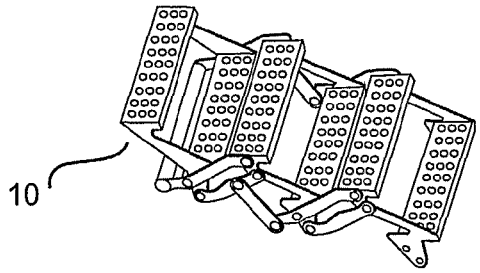
Figure 2B:
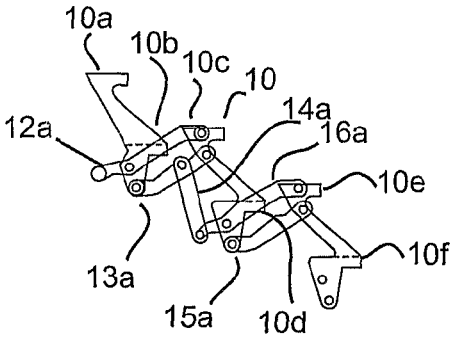
Figure 2C:
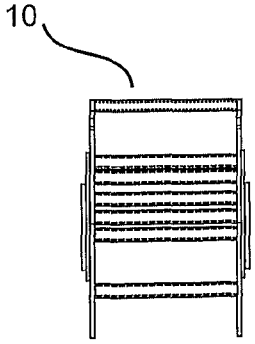
Figure 3A:
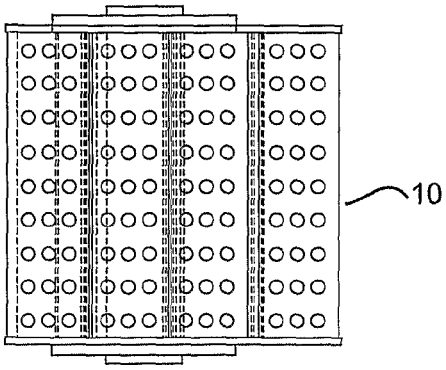
FIGS. 3*a* to 3*d* show various views of a section of an access device according to an embodiment of the present invention in retracted/contracted configuration.
Figure 3B:
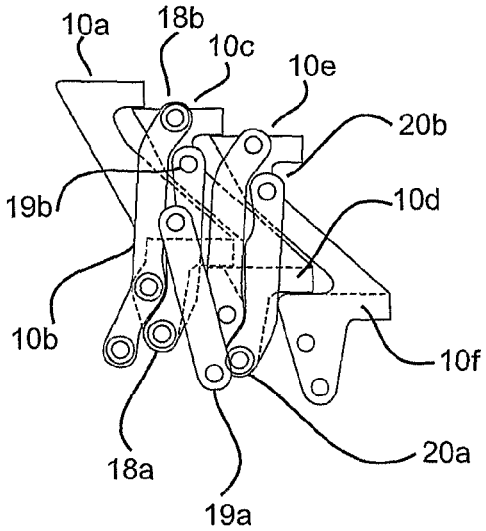
Figure 3C:
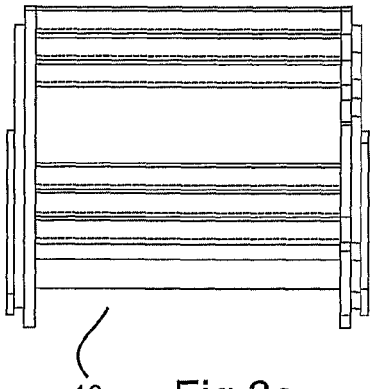
Figure 3D:
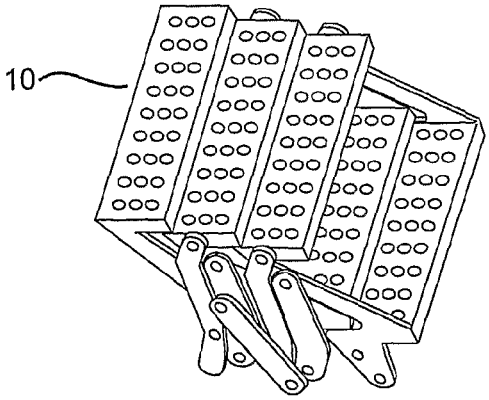
Figure 4A:
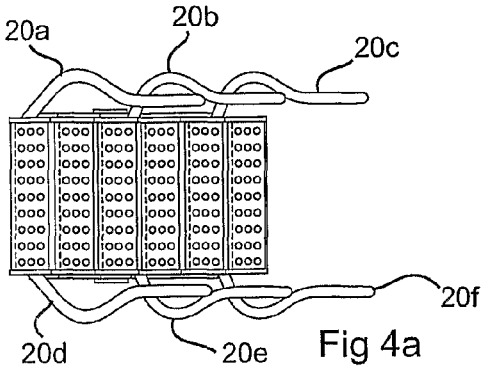
FIGS. 4*a* to 4*d* show various views of a section of an access device according to an embodiment of the present invention in extended configuration, the access device including handrails.
Figure 4D:
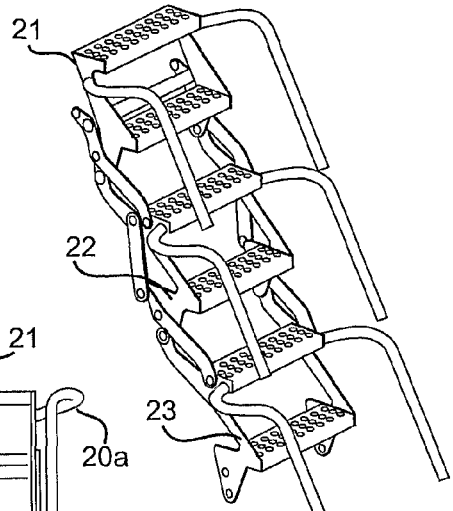
Figure 4B:
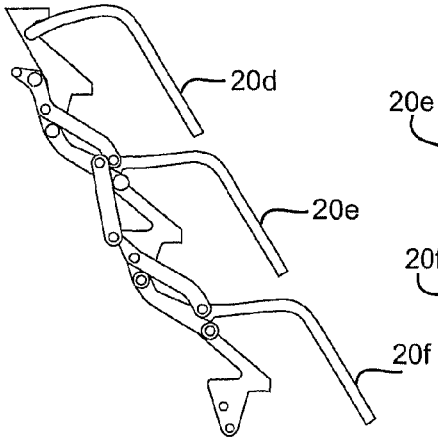
Figure 4C:
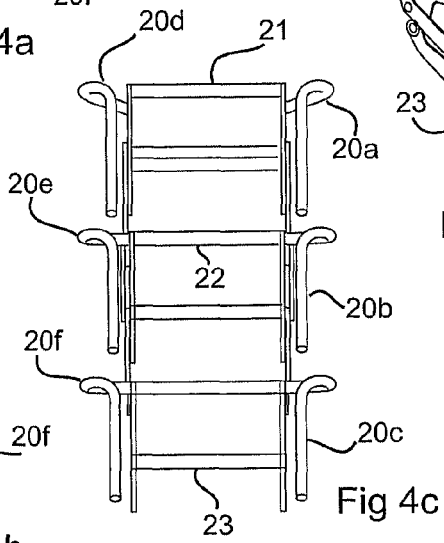
Figure 5A:
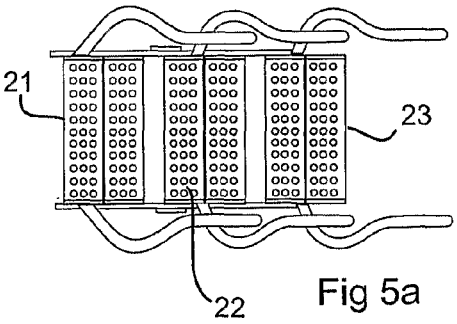
FIGS. 5*a* to 5*d* show various views of a section of an access device according to an embodiment of the present invention in partially retracted configuration, the access device including handrails.
Figure 5D:
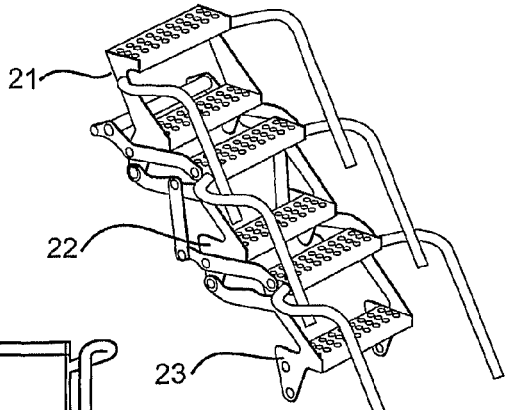
Figure 5B:
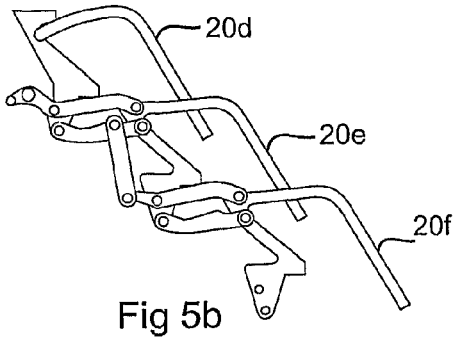
Figure 5C:
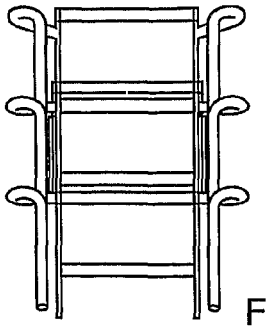
Figure 6A:
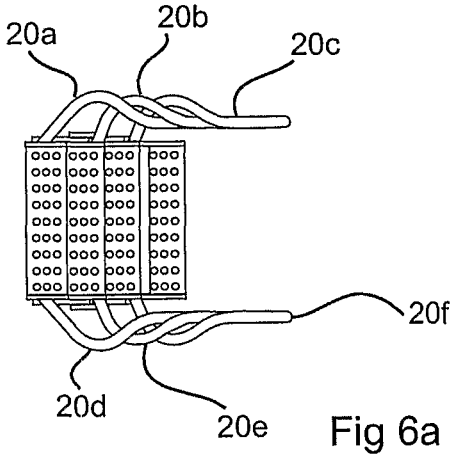
FIGS. 6*a* to 6*d* show various views of a section of an access device according to an embodiment of the present invention in retracted configuration, the access device including handrails.
Figure 6D:
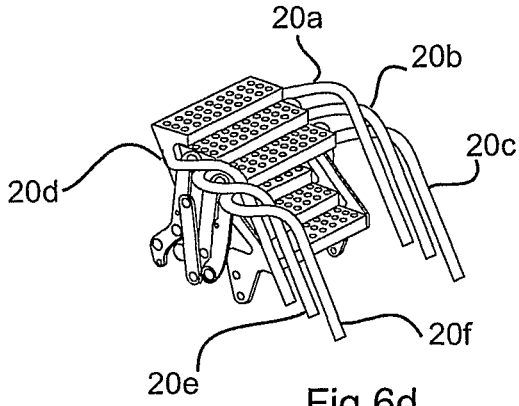
Figure 6B:
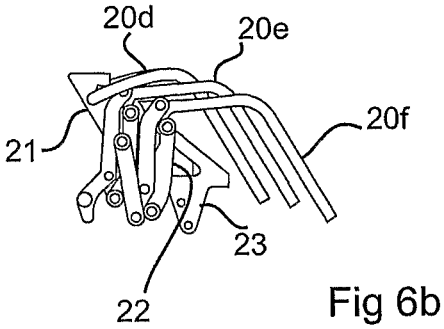
Figure 6C:
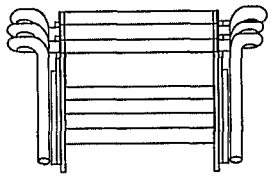

FIG. 2*b* in particular demonstrates the longitudinal contraction/extension properties of the steps. The side connectors allow fixed pairs of treads to concertina in unison, such that they nest together, as shown in FIG. 3*b*. The top tread 10*a*, 10*c*, 10*e* of each pair partially overlays the top tread of the adjacent pair. Likewise, the bottom tread 10*b*, 10*d*, 10*f* of each pair partially overlays the respective bottom tread of the adjacent pair. The connectors (or linkages) collapse/open in a scissor like pivoting action, somewhat like the action of expandable lattice/trellis. This arrangement of the present invention permits the steps to take up reduced storage space once collapsed, but are readily extended by applying an opening force action at any point, preferably in an area near the top or bottom of the step run. FIGS. 3*a*-3*d* show a fully collapsed/contracted configuration of the steps.

The linking connectors are provided at the respective sides of the treads. Thus, the pair of risers connecting one step to another of a pair, and their respective side connectors for a four bar linkage for each side to permit collapse of one pair towards or extension away from the next adjacent pair. The connectors are attached at pivot points, such as at 18*a* to 20*b*. Other pivot points are ensilaged, as shown.

In use, the steps are mounted to a vehicle, such as a grader. An actuator mechanism, such as a hydraulic ram, or electrical motor is used to deploy the steps from a collapse/contracted position. The connectors, which can be termed linkages, allow the steps to concertina open and thus extend longitudinally downwards. Once deployed, a user can climb/walk up the treads. To retract the steps, the reverse procedure is employed. The actuator mechanism, or a return spring mechanism, or combination of both to ease retraction forces of the weight of the steps due to gravity, returns the steps to a collapsed/contracted configuration. Thus the steps are nested together in a closed position with the steps effectively raised from the ground at a position close to the cabin adjacent the top tread.

The blade of a grader can move to almost any position, consequently an access system or device, such as an extending ladder or steps, needs to be compact to avoid the blade being moved to a position which would damage the ladder or steps. It is possible to punch the cabin windows out of the vehicle cabin with the blade and/or damage the door and/or steps if not operated correctly, as does happen.

FIGS. 4*a* through 6*d* show deployment/retraction stages of the device corresponding to FIGS. 1*a* to 3*d*, except that the set of steps has multiple handrails 20*a* to 20*f*. It will be appreciated that fewer, longer handrails may be fitted, or more handrails, especially where the access device is longer with a greater number of sections 20, 21, 23. The sections provide tread units, in this instance each tread unit having two treads or steps. These sections are hinged or otherwise articulatory connected to at least one other section. It will be appreciated that the topmost and bottom most section will only be connected to its next adjacent section, whereas intermediate sections connect to at least one above and at least one below. FIGS. 4*a* to 6*d* show snapshots of stages during retraction of the access device, or deployment if taken in reverse. The handrails nest together for the collapsed, retracted position. That is they interfit within one another to a compact "stacked" arrangement.

FIG. 7*a* shows the access device (steps) 33 in a deployed configuration on a grader 30. The steps are clearly seen extending downwards between the rear wheel 32 and the graders blade 31. The steps are mounted to the sill 35 entering the operator's cabin 34.

FIGS. 7*b* to 7*d* show the steps in partially retracted configuration as they are folded up towards their compact retracted position for movement of the vehicle.

Figure 8A:
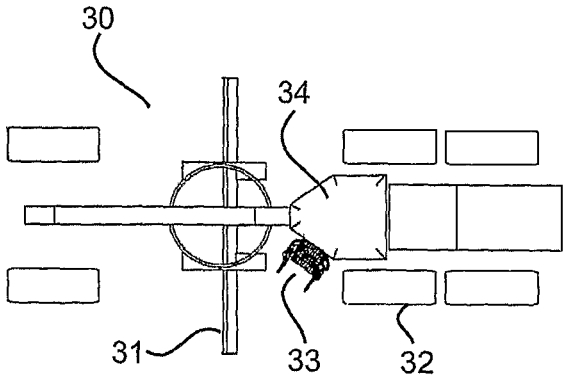
FIGS. 8*a* to 8*c* show an access device according to an embodiment of the present invention in retracted mode on a grader.
Figure 8B:
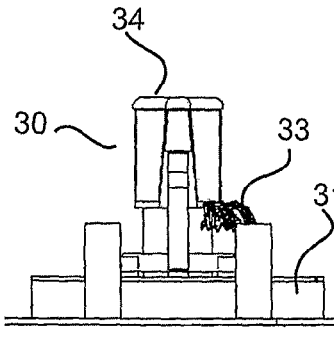
Figure 8C:
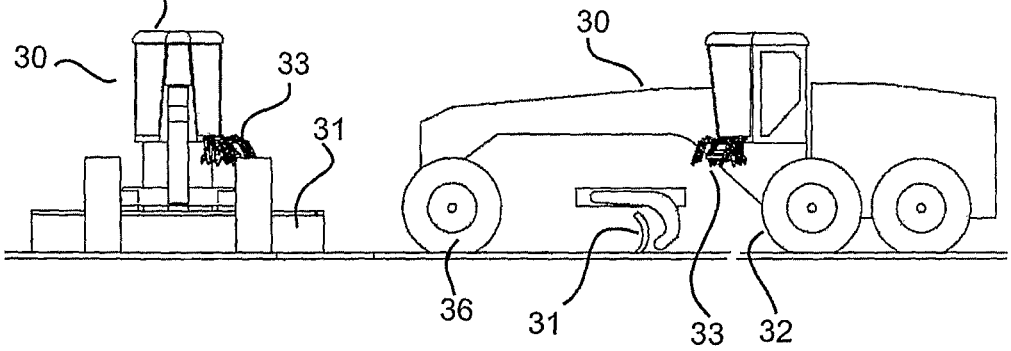

FIGS. 8*a* to 8*c* show the access device retracted in a stowed position for movement of the vehicle. The sections and tread units are compactly nested together due to the pivoting articulation members connecting consecutive sections. These allow the tread units to nest such that the top tread of one unit rests adjacent the top tread of an adjacent unit, and the bottom tread of a unit rests adjacent the bottom tread of an adjacent unit. Similarly, the handrails, where fitted, are shaped so as to allow one to fit through the next for compact stowage.

The invention claimed is:

1. A retractable access device for a vehicle, the access device having a longitudinal extent when deployed, including a multiplicity of rigid tread units each tread unit having multiple fixed treads, that are fixed relative to one another, the tread units interconnected in series by connectors pivotably mounted with respect to the tread units providing articulation between adjacent said treat units, such that the connectors permit the access device to contract longitudinally and the tread units to be closed together during retraction of the access device, and at least one tread of each tread unit stows intermediate the treads of at least one other of the tread units when the access device is retracted.

2. The retractable access device according to claim 1, wherein the tread units retract to a nested configuration with one tread overlaying the next.

3. The retractable access device according to claim 2, wherein two or more of the treads are interconnected one to the next by pivot linkages.

4. The retractable access device according to claim 3, wherein the pivot linkages include at least one link member pivotably connected at each end thereof to a respective tread.

5. The retractable access device according to claim 4, including a pair of link members pivotably mounted at each end of each member to each side of a respective tread unit to form a four bar linkage for each side between two consecutive tread units.

6. An access system for a vehicle, including an access device having at least two tread units including a first tread unit and a second tread unit each having at least two fixed treads for supporting a user when in use, wherein the at least two fixed treads are fixed relative to one another, and each said tread unit articulatory connected to the next adjacent said tread unit by articulation connections such that the tread units close together during upward longitudinal retraction of the access device from a downwardly extended deployed orientation with the first tread unit above the second tread unit when the access device is deployed, characterised in that adjacent said tread units each includes a first fixed tread and a second fixed tread, and when retracted into a nested configuration the first fixed tread of a first said tread unit at least partially overlays the first fixed tread of the second said tread unit, and the second fixed tread of said first tread unit at least partially overlays the second fixed tread of the second tread unit, with the first fixed tread of the second tread unit positioned at least partially between the first and the second fixed treads of the first tread unit.

7. The access system according to claim 6, wherein at least the first and second tread units are interconnected one to the next by pivot linkages.

8. The access system according to claim 7, wherein the pivot linkages include at least one link member pivotably connected at each end thereof to a respective tread unit.

9. The access system according to claim 8, including a pair of said link members pivotably mounted at respective pivot points at each end of each said link member to each side of a respective tread unit to form a four bar linkage for each side between two consecutive treads.

10. The access system according to claim 7, wherein pivot linkages form four bar linkages at either side of the tread units, and retracting one tread unit causes a retraction force to be applied through the pivot linkages to retract the connected tread units.

11. The access system according to claim 1, including at least one handrail mounted to the access device.

12. The access system according to claim 11, including multiple handrails mounted to the access device, the handrails collapsing together with each handrail nesting with an adjacent handrail when the access device is retracted.

13. The access system according to claim 6, wherein the access means contracts or extends in a concertina or scissor arrangement.

14. The access system according to claim 6, wherein the first tread of each said adjacent tread units is the top tread of that respective tread unit, and the second tread of each said adjacent tread units is the bottom tread of that respective tread unit.

15. The access system according to claim 6, wherein the at least two fixed treads in each unit are fixed parallel to each other.

16. A method of retracting a deployed access device for earth moving equipment, the access device including a multiplicity of tread units, each tread unit including two or more fixed treads that are fixed relative to one another for supporting a user, the method including bringing the tread units closer together during a longitudinal contraction of the deployed access device, whereby the tread units nest together when the access device is fully retracted such that a first tread of a first tread unit overlays a first tread of a second tread unit and a second tread of the first tread unit overlays a second tread of the second tread unit, the first tread of the second tread unit being at least partially between the first and second treads of the first tread unit when the access device is retracted.

17. The method according to claim 16, wherein the tread units are successively connected by respective linking means such that applying a force to retract the access device acts through the linking means to retractably bring the treads of the tread units together.

18. The method according to claim 17, wherein the linking means are linking members forming four bar linkages at either side of the tread units, and retracting one tread unit causes a retraction force to be applied through the linkages to retract the connected tread units in a longitudinal direction of the access device.

19. The method according to claim 16, wherein contraction of the access device nests the treads adjacent one another in a retracted configuration.

20. The method according to claim 19, wherein the tread units are successively connected by respective linking means such that applying a force to retract the access device acts through the linking means to retractably bring the tread units together.

21. The method according to claim 16, whereby the first tread of the second tread unit passes from below the second tread of the first tread unit to above the second tread of the first tread unit during retraction.

22. The method according to claim 16, whereby said multiple tread units nest together when the access device is retracted, with the top treads of the tread units overlying one another, and the bottom treads of the tread units overlying one another.

23. An access system for a vehicle, including a sectional access device having sections, at least two of the sections each including at least one tread unit having multiple fixed treads that are fixed relative to one another for supporting a user when in use, and each of the at least two sections articulatory connected together by articulation connections whereby the at least two tread units close together during upward longitudinal retraction of the access device from a downwardly extended deployed orientation, with each of the at least two said tread units having at least one tread that is stowed at least partially between treads of the multiple fixed treads of an other of the at least two tread units when the access device is retracted.

24. The access system according to claim 23, wherein the sections close together to form retracted access device with the tread units nested together.

25. A retractable access device for a vehicle, the access device having a longitudinal extent when deployed, including a multiplicity of rigid tread units, each tread unit having multiple fixed treads, that are fixed relative to one another, the tread units interconnected by connectors pivotably mounted with respect to the tread units providing articulation between adjacent said tread units, the tread units nested together after retraction of the access device with at least one tread of each tread unit stowed intermediate the treads of at least one other of the tread units when the access device is retracted.

26. A retractable access device for a vehicle, the access device having a longitudinal extent when deployed, including a multiplicity of tread units, each tread unit having at least an upper tread and a lower tread, that are fixed relative to one another, the tread units interconnected by connectors pivotably mounted with respect to the tread units providing articulation between adjacent said tread units, the tread units nested together after retraction of the access device with the upper treads adjacent one another and the lower treads lying adjacent one another when the access device is retracted.

* * * * *

UNITED STATES PATENT AND TRADEMARK OFFICE

CERTIFICATE OF CORRECTION

PATENT NO. : 8,668,216 B2
APPLICATION NO. : 12/922990
DATED : March 11, 2014
INVENTOR(S) : Nathan John Ellement It is certified that error appears in the above-identified patent and that said Letters Patent is hereby corrected as shown below:

In the Claims:

At Column 6, Claim 1, line 3, "treat" should be -tread-.

Signed and Sealed this
Twenty-second Day of July, 2014

Michelle K. Lee

Michelle K. Lee
*Deputy Director of the United States Patent and Trademark Office*